US011506207B1

(12) United States Patent
Sundheim et al.

(10) Patent No.: US 11,506,207 B1
(45) Date of Patent: Nov. 22, 2022

(54) PORTABLE, ROTARY VANE VACUUM PUMP WITH A QUICK OIL CHANGE SYSTEM

(71) Applicant: Gregory S. Sundheim, Englewood, CO (US)

(72) Inventors: Gregory S. Sundheim, Englewood, CO (US); Thomas C. Shoemaker, Englewood, CO (US); Brett W. Renck, Englewood, CO (US)

(73) Assignee: Gregory S. Sundheim, Englewood, CO (US)

( * ) Notice: Subject to any disclaimer, the term of this patent is extended or adjusted under 35 U.S.C. 154(b) by 0 days.

(21) Appl. No.: 17/827,267

(22) Filed: May 27, 2022

Related U.S. Application Data

(60) Provisional application No. 63/215,313, filed on Jun. 25, 2021.

(51) Int. Cl.

| | |
|---|---|
| ***F04C 29/02*** | (2006.01) |
| ***F04C 25/02*** | (2006.01) |
| ***F04C 28/24*** | (2006.01) |
| ***F04C 28/06*** | (2006.01) |
| ***F04C 18/344*** | (2006.01) |

(52) U.S. Cl.
CPC ..... *F04C 29/025* (2013.01); *F04C 18/3441* (2013.01); *F04C 25/02* (2013.01); *F04C 2220/10* (2013.01); *F04C 2240/30* (2013.01)

(58) Field of Classification Search
CPC ..... F04C 29/025; F04C 29/028; F04C 25/02; F04C 28/24; F04C 28/06
See application file for complete search history.

(56) References Cited

U.S. PATENT DOCUMENTS

| | | | |
|---|---|---|---|
| 4,608,002 | A | 8/1986 | Hayase et al. |
| 4,631,006 | A | 12/1986 | Murray |
| 4,726,740 | A | 2/1988 | Suzuki et al. |

(Continued)

OTHER PUBLICATIONS

International Searching Authority; International Search Report and Written Opinion; International Application No. PCT/US2022/033542; dated Sep. 2, 2022; 12 pgs.

(Continued)

*Primary Examiner* — Deming Wan
(74) *Attorney, Agent, or Firm* — Cochran Freund & Young LLC

(57) ABSTRACT

A portable vacuum pump with a lubricating oil system having a quick oil change system. The oil change system includes at least two containers of oil and a switch mechanism operable to initially place the first container in fluid communication with the vacuum pump to serve as the primary oil reservoir while isolating the second container from such fluid communication. Then in a snap action, the switch mechanism can be flipped to place the second container with clean oil in fluid communication with the vacuum pump to serve as the primary oil reservoir and isolate the first container from fluid communication when its oil becomes dirty, all while the vacuum pump is still operating to evacuate an AC/R system. The first container can then be removed, refilled with clean oil, and returned in place and the switch mechanism flipped back to it when the second container of oil becomes dirty.

25 Claims, 15 Drawing Sheets

(56) References Cited

U.S. PATENT DOCUMENTS

| | | | | |
|---|---|---|---|---|
| 6,474,115 | B1 * | 11/2002 | Preston | D06F 43/02 68/140 |
| 7,674,096 | B2 | 3/2010 | Sundheim | |
| 8,651,828 | B2 | 2/2014 | Sundheim | |
| 9,080,569 | B2 * | 7/2015 | Sundheim | F04C 23/006 |
| 10,837,446 | B2 | 11/2020 | Hong | |
| 2006/0073033 | A1 * | 4/2006 | Sundheim | F04C 18/3441 417/410.3 |
| 2008/0124237 | A1 * | 5/2008 | Viken | F04C 14/08 418/142 |
| 2010/0183467 | A1 | 7/2010 | Sundheim | |
| 2015/0064042 | A1 | 3/2015 | Shimaguchi et al. | |

OTHER PUBLICATIONS

Fieldpiece Vacuum Pump With RunQuick Oil Change System Operator's Manual, pp. 1-18, copyrighted 2021; v06 downloaded Jul. 19, 2021.

* cited by examiner 20
22
26
6
33
9
41
27
25
3
17
31
7
9
19
23
11
13
R
15
27'
23
17
19
27''
25
31'
41
4

Fig. 12
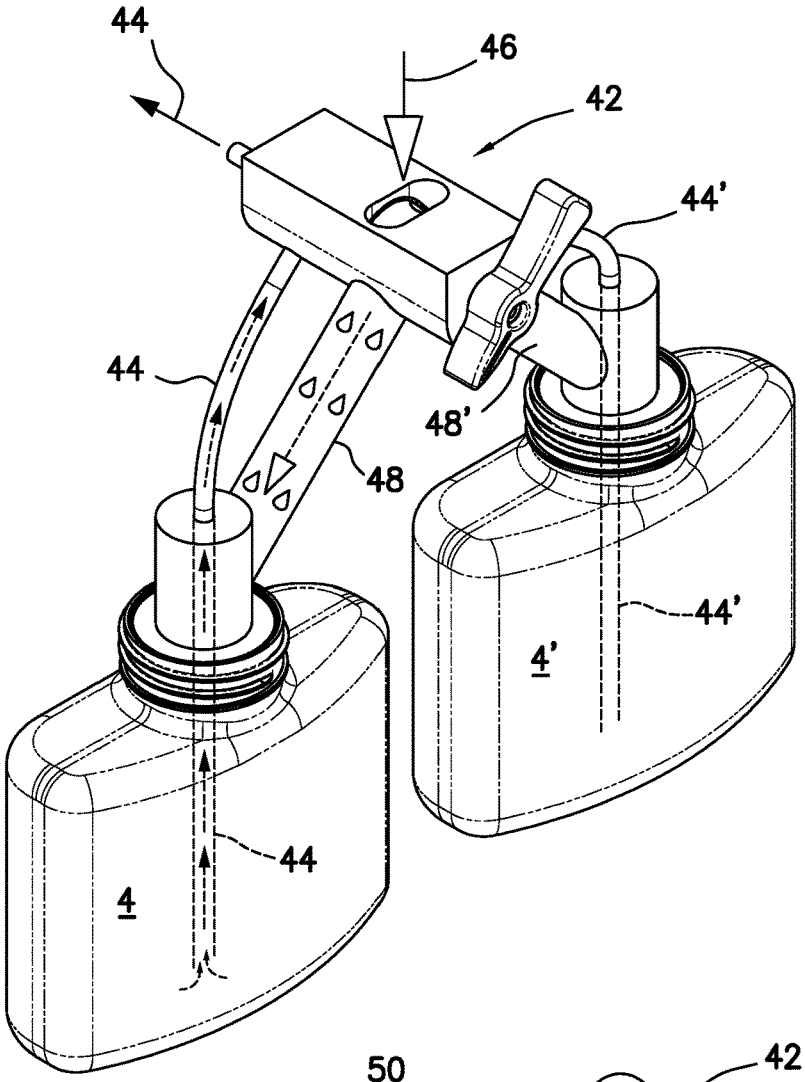
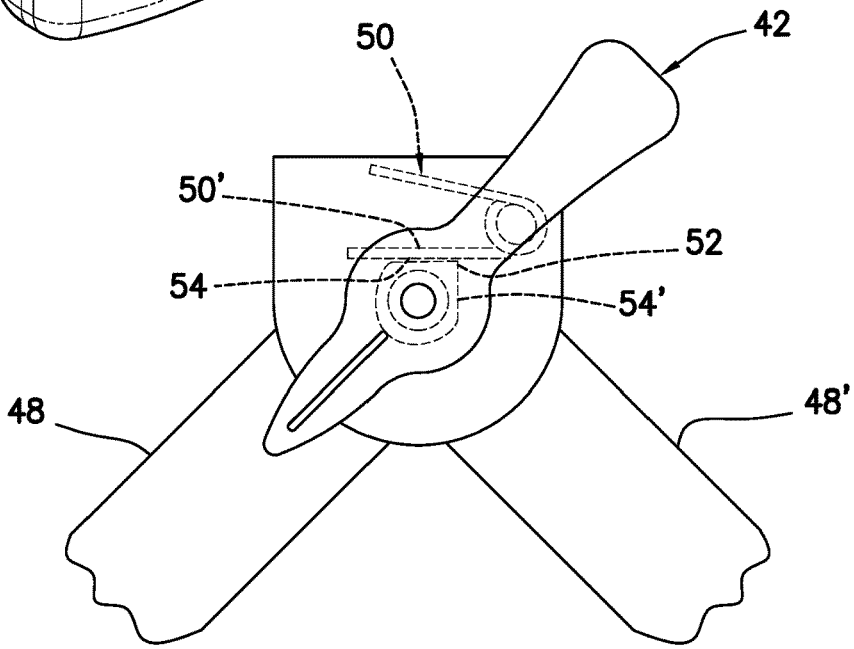
Fig. 13

Fig. 14
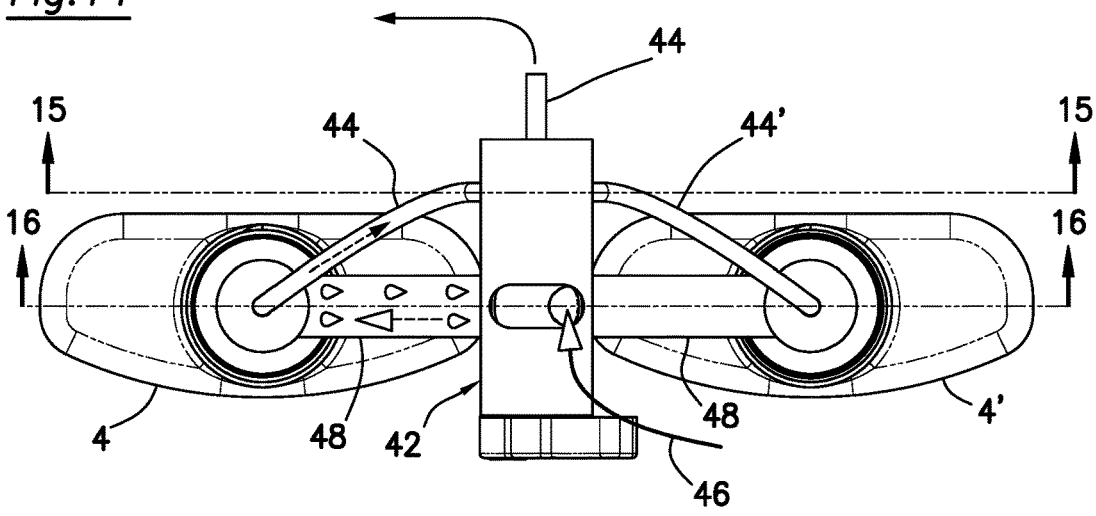
Fig. 15
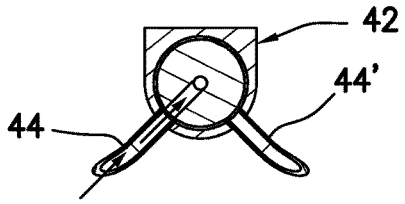
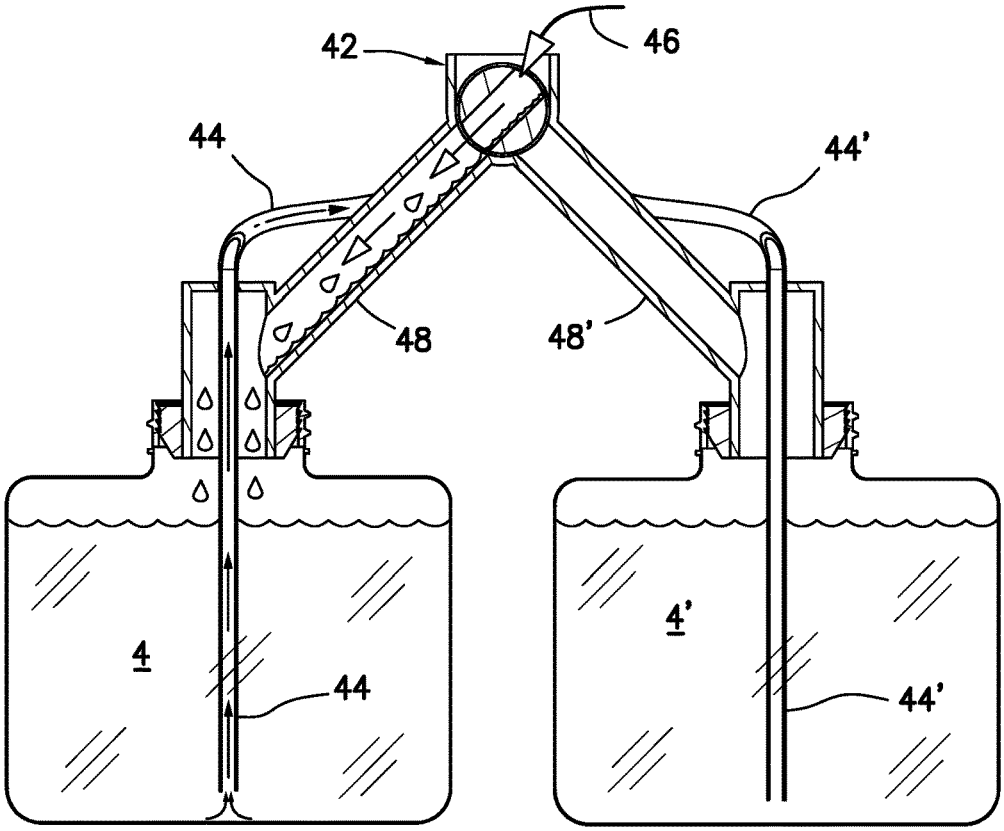
Fig. 16

Fig. 17
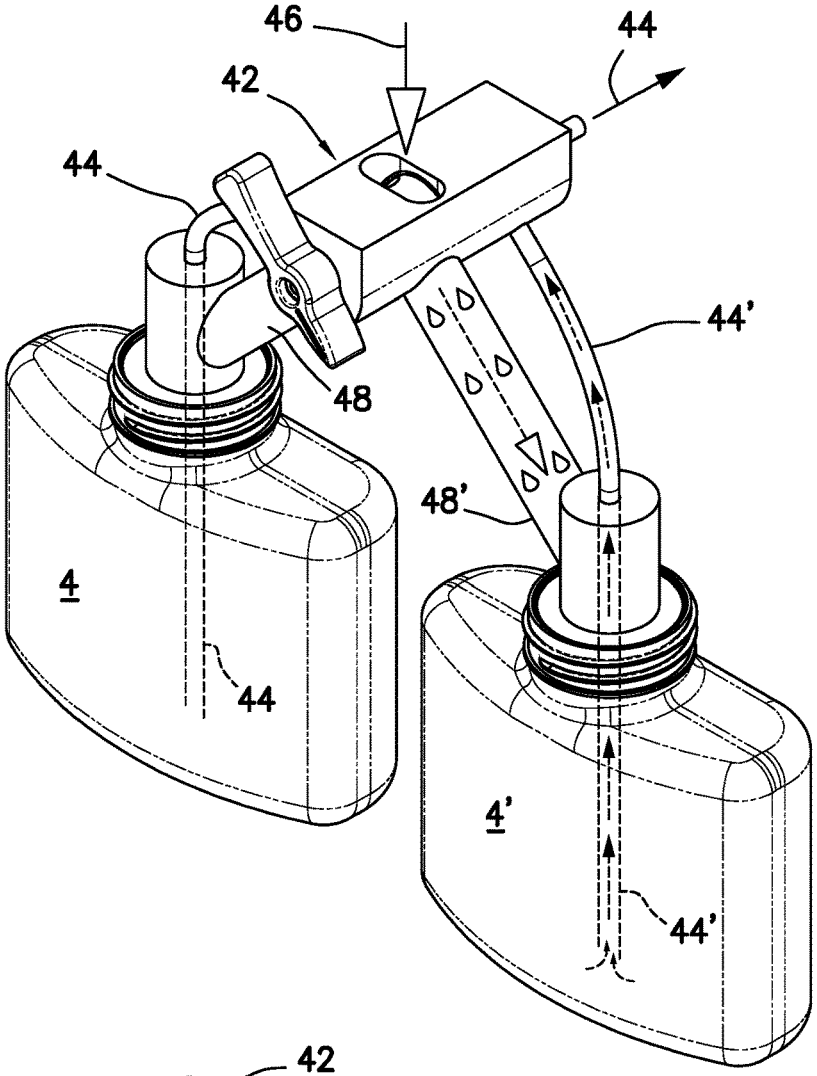
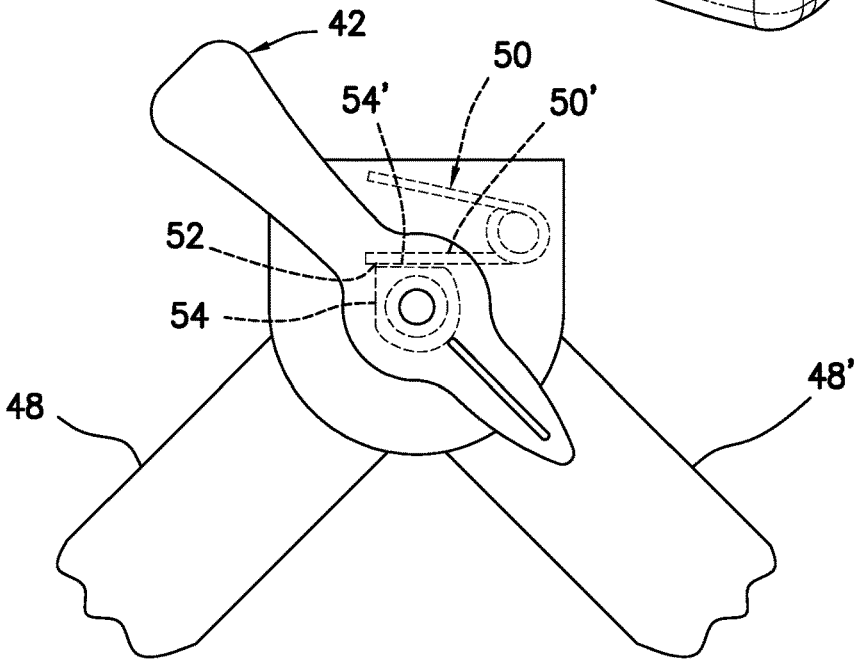
Fig. 18

Fig.19
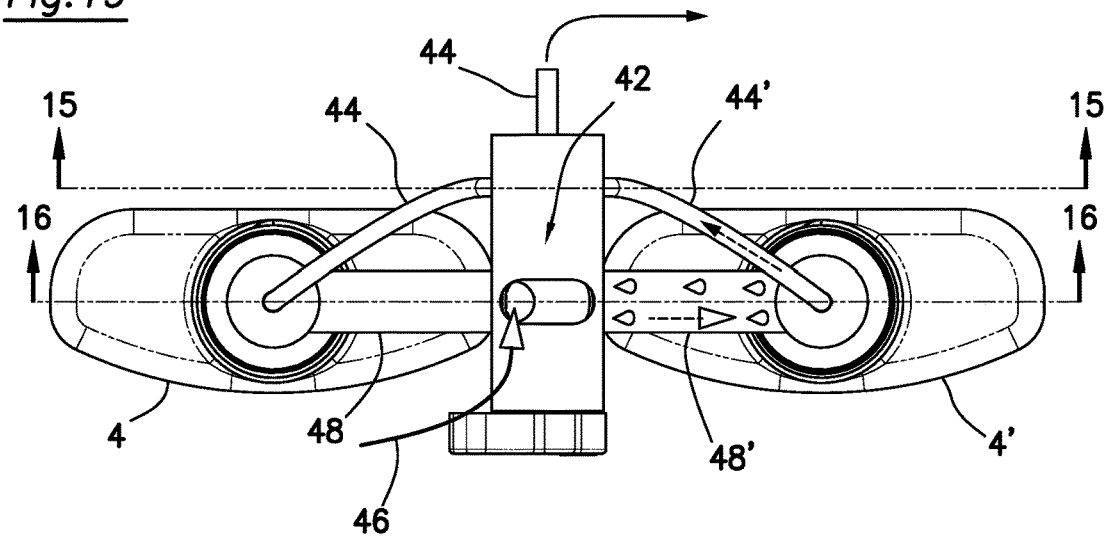
Fig.20
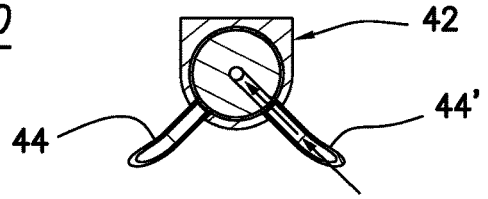
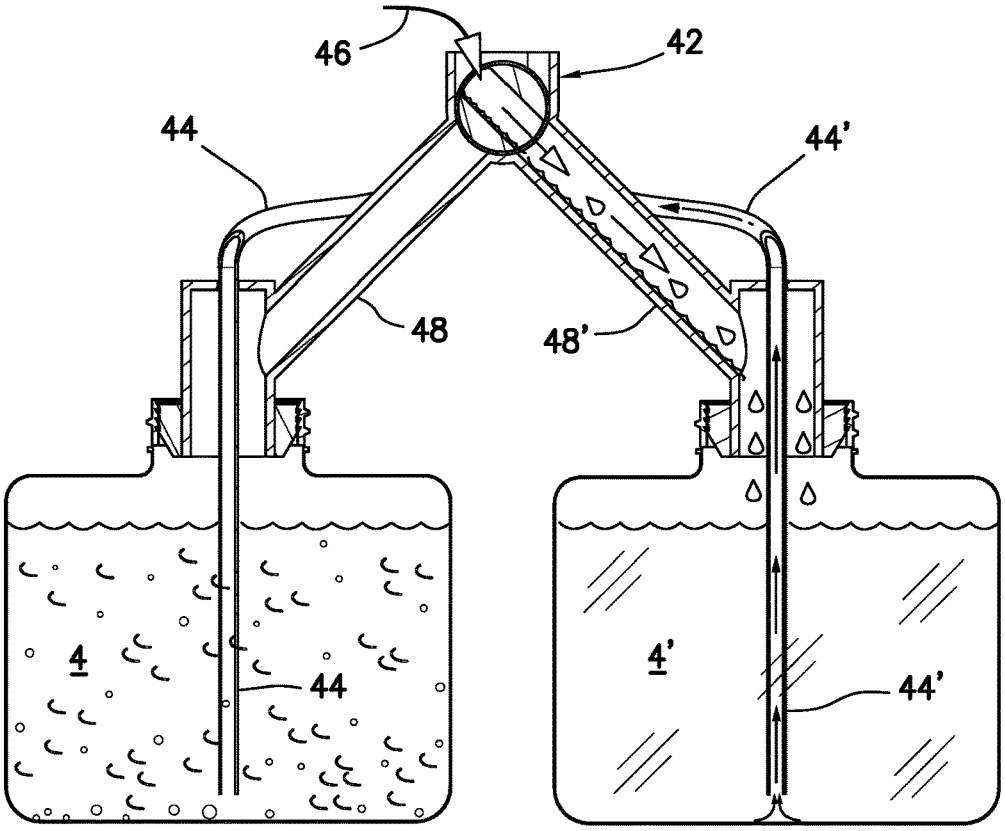
Fig.21

PORTABLE, ROTARY VANE VACUUM PUMP WITH A QUICK OIL CHANGE SYSTEM

RELATED APPLICATION

The present application is based on and claims priority to the Applicant's U.S. Provisional Patent Application 63/215,313, entitled "Portable, Rotary Vane Vacuum Pump with a Quick Oil Change System," filed on Jun. 25, 2021.

BACKGROUND OF THE INVENTION

Field of the Invention

This invention relates to the field of portable, rotary vane vacuum pumps and more particularly to the field of such pumps for use in servicing air conditioning and refrigeration systems.

Discussion of the Background

Portable, rotary vane vacuum pumps are widely used in the servicing of air conditioning and refrigerant systems to draw down a relatively deep vacuum before the system is recharged. In a typical servicing procedure, the refrigerant of the system is first recovered and the unit opened to the atmosphere for repairs. Thereafter and prior to recharging it, the air and any residual moisture must be pulled out of the system, otherwise its performance will be adversely affected. More specifically, any air and moisture left in the system will interfere with the refrigerant's thermal cycle causing erratic and inefficient performance. Additionally, any residual air and moisture can cause undesirable chemical reactions within the system components and form ice crystals within the system contributing to accelerated component failures.

Most such vacuum pumps are submerged or at least partially submerged in a surrounding sump of oil. The oil sump provides a supply of oil for lubricating and sealing the rotating vanes inside the pump allowing the pump to draw a deep vacuum. The exterior oil sump about the operating pump also serves to cool it. Such arrangements typically feed the oil from the sump into the interior of the pump along a path or paths adjacent one or more of the pump bearings. The oil is then redistributed by rotational forces to the vanes and inner perimeter of the pump cylinder thereby providing lubrication and seals for the rotating parts. The oil level in these submerged sump designs must be kept above the inlet of the oil path to the pump's interior otherwise the pump will not receive a fresh and continuous supply of oil and the pump will not operate properly to pull a deep vacuum.

Such submerged or partially submerged designs are subject to oil being undesirably drawn or sucked from the sump back through the pump into the system being evacuated when the pump is shut off. This is the case whether the pump is intentionally turned off (e.g., by the operator) or unintentionally shut down (e.g., someone trips over the power cord to the pump or a circuit breaker is tripped). In such cases and if the air conditioning or refrigeration system being evacuated is not isolated from the pump, the vacuum in the system as indicated above will draw or suck oil from the sump backwards through the pump and into the system until there is finally a break to atmosphere somewhere. At this point, oil is undesirably in the air conditioning or refrigeration system and the system should be cleaned of this oil before proceeding, involving additional time and expense. The pump is also undesirably filled with incompressible oil which can result in damage to the pump parts and their alignment upon restarting. Further, the hoses connecting the pump and system being evacuated are usually filled with oil and disconnecting them typically creates a messy flow of oil in the immediate service area.

To address these draw or suck back problems, many pump manufacturers install a ball or other check valve arrangement on the input line to the pump from the system being evacuated. However, the ball or similar structure is an obstruction to the flow and can significantly reduce the flow rate from the system increasing the time and expense of the evacuation process. Further, as the evacuation becomes deeper and if the ball or similar member is spring biased toward its closed position, the spring force may overcome any small pressure differential on either side of the ball and prematurely close the check valve before the desired vacuum is drawn.

Many pump manufacturers employ a relatively effective way to address the draw back problem of oil into the system being evacuated by providing a manually operated isolation valve between the system and the pump. However, this relies on the operator remembering to close the valve once the desired vacuum has been drawn. More importantly, this approach does not prevent the draw back problem if the pump is unintentionally shut down (e.g., by someone tripping over the power cord to the pump or a circuit breaker is tripped). Further, neither this manual valve approach nor the check valve discussed above prevents oil from being drawn in and undesirably filling the pump. To address the pump problem, some manufacturers provide a manually operated venting valve to be activated once the pump has been isolated from the evacuated system. However, this again relies on the operator remembering to open the valve and does not prevent the draw back problem if the pump is unintentionally shut down.

The refrigerant in an air conditioning and refrigeration (AC/R) system works most efficiently when the refrigerant is 100% pure and with no contamination. The contamination may be in the form of water vapor, air or other gases, and compounds. The life and efficiency of the AC/R system can be severely negatively impacted by any contaminants left in it. To ensure that the AC/R system has minimal contamination, a deep vacuum (as deep as 500 or even 20 microns of mercury) is typically required to be pulled on the system to extract or draw out most of the system contaminants. Many manufacturers of equipment call out a specific vacuum level to be pulled and then held for a period of time to ensure that the system can be cleared of contaminants. Some even require doing this multiple times (e.g., three) while sweeping the system with clean, dry nitrogen between evacuations. In any event, the importance of having a clean, dry, and deeply evacuated system prior to charging or re-charging it with refrigerant cannot be overstated. Similarly, the ability to quickly change the oil without interrupting the evacuating operation of the vacuum pump is paramount. In smaller systems, this can amount to saving many hours and in larger systems, it may save days or even weeks of time.

With these and other problems in mind, the present invention was developed. In it, a pump design is provided that is not submerged in the sump oil and additionally has an automatic arrangement to safely break the vacuum in the pump and in the system being evacuated should the pump be intentionally or unintentionally shut down. Additionally, a quick oil change system is provided using at least two containers of oil and a switch mechanism selectively operable to enable the oil change system to draw oil from and return oil to either of the two oil containers. In doing so, the switch mechanism respectively makes the oil container that is in use the primary oil reservoir in fluid communication with the vacuum pump and isolates the other oil container from fluid communication. When the oil of the container in use becomes contaminated or dirty, the switch mechanism can be instantly flipped to make the clean, other oil container serve as the primary oil reservoir while isolating the dirty oil container. The dirty oil container can then be removed and replaced with a third container of clean oil, all without interrupting the evacuating operation of the vane pump. The replacement, third container of clean oil can be a new one or just the removed, dirty first container refilled with clean oil and returned in place. In either case and in a similar operating manner, the switch mechanism can subsequently be flipped back to make the clean container (whether a new one or the first container refilled) the primary oil reservoir when the second container becomes dirty and needs to be replaced.

SUMMARY OF THE INVENTION

This invention involves a portable, rotary vane vacuum pump with a lubricating oil system having a quick oil change system. The lubricating oil system includes an oil inlet arrangement with a primary oil container or reservoir, a secondary oil container or reservoir, and a small oil pump mechanism between the two containers. The primary and secondary oil containers are both continuously open to atmosphere and at ambient pressure. The pump mechanism initially moves oil from the primary oil container to the much smaller secondary oil container. In doing so, oil is drawn into the housing bore of the evacuated vane pump via a first path or passage downstream of the oil pump mechanism. The first oil path or passage is in fluid communication with the secondary container which as indicated above is open to the atmosphere and at ambient pressure. The secondary oil container or reservoir also holds only a small volume fraction (e.g., 1/10 or less) of the oil in the primary oil container or sump which then essentially holds all of the oil for the system. The lubricating oil system further includes an oil return arrangement to deliver the oil from the operating vane pump and secondary oil container back to the primary oil container while the primary and secondary oil containers still remain open to the atmosphere and at ambient pressure.

The quick oil change system includes at least two containers of oil and a switch mechanism. The switch mechanism is operable to initially place the first of the two containers in fluid communication with the vacuum pump to serve as the primary oil reservoir while isolating the second container from such fluid communication. This position can be held until the oil of the first container becomes contaminated or dirty. Then in a snap action, the switch mechanism can be flipped to place the second container with clean oil in fluid communication with the vacuum pump to serve as the primary oil reservoir and isolate the dirty first container from fluid communication, all while the vacuum pump is still operating to evacuate the AC/R system. The isolated first container of dirty oil can then be removed and replaced with a third container of clean oil and the switch mechanism flipped back to place the replacement third container of clean oil in fluid communication with the vacuum pump to serve as the primary oil reservoir when the second container of oil becomes dirty. The third container in this regard can be a new one or simply the dirty, first container refilled with clean oil and returned in place. In either case, the process can then be repeated as needed to keep the vacuum pump always operating with clean oil.

BRIEF DESCRIPTION OF THE DRAWINGS

FIGS. 12-16 are additional views of the quick oil change system in operation to use a first container of oil as the primary oil reservoir for the vacuum pump while isolating the reserve, second container of oil from use.

FIGS. 17-21 are similar to FIGS. 12-16 but showing the quick oil change system having been switched to use the reserve, second container of clean oil as the primary oil reservoir for the vacuum pump and isolating the first container from use when its oil becomes contaminated or dirty and needs to be replaced.

DETAILED DESCRIPTION OF THE INVENTION

Figure 1:
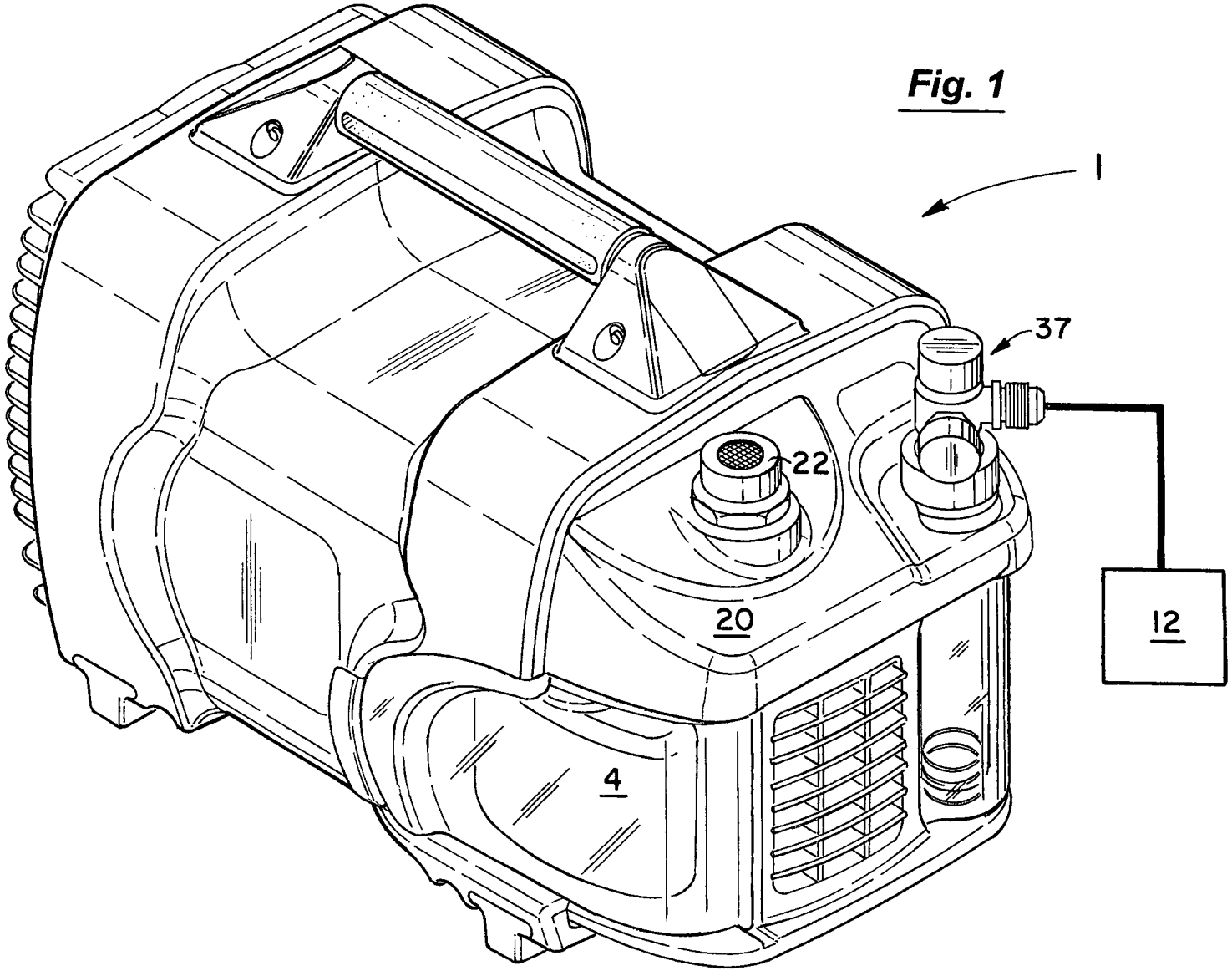
FIG. 1 is a perspective view of the portable, rotary vane pump of the present invention.
Figure 2:
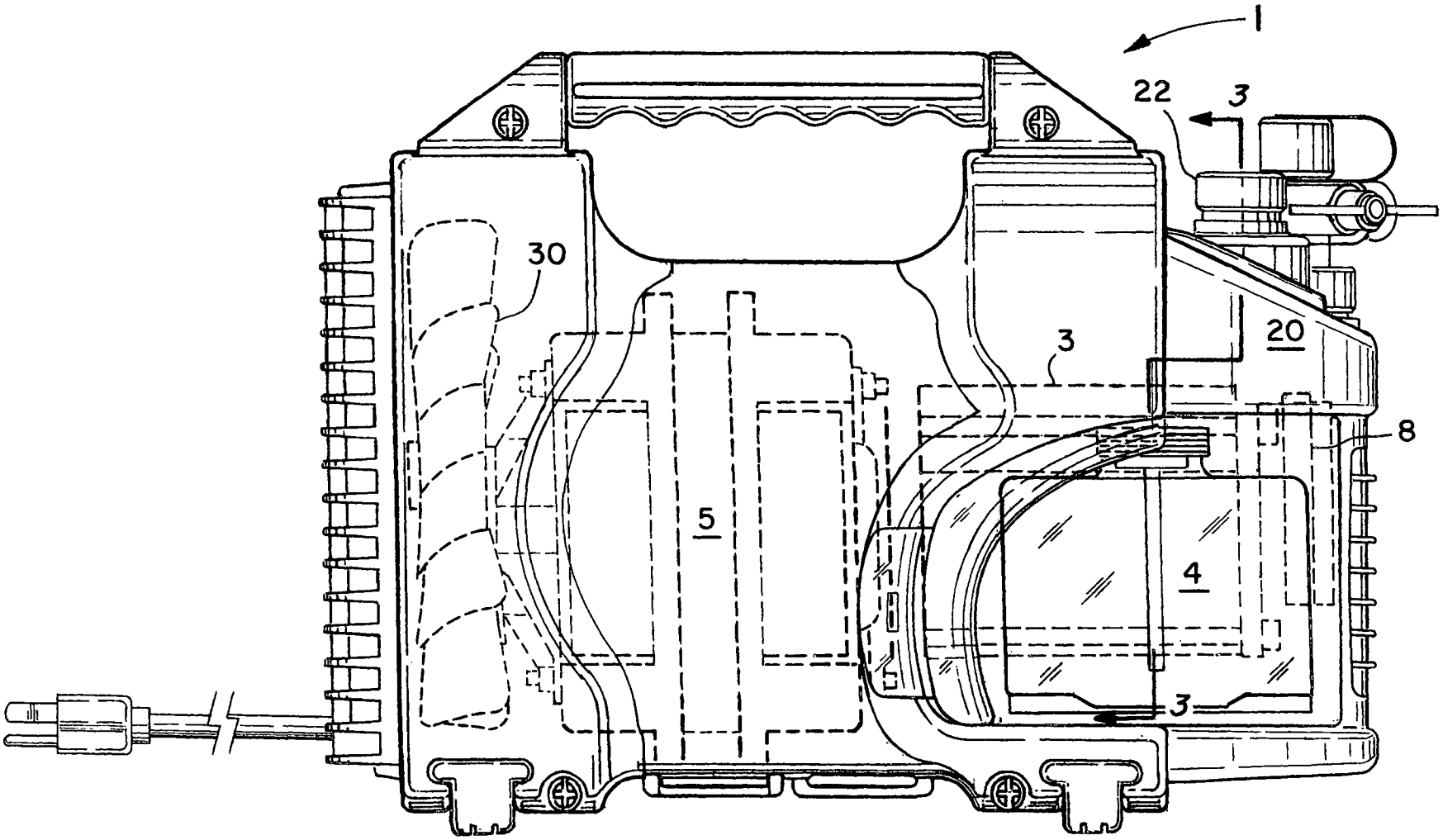
FIG. 2 is a side view of the portable pump.
Figure 3:
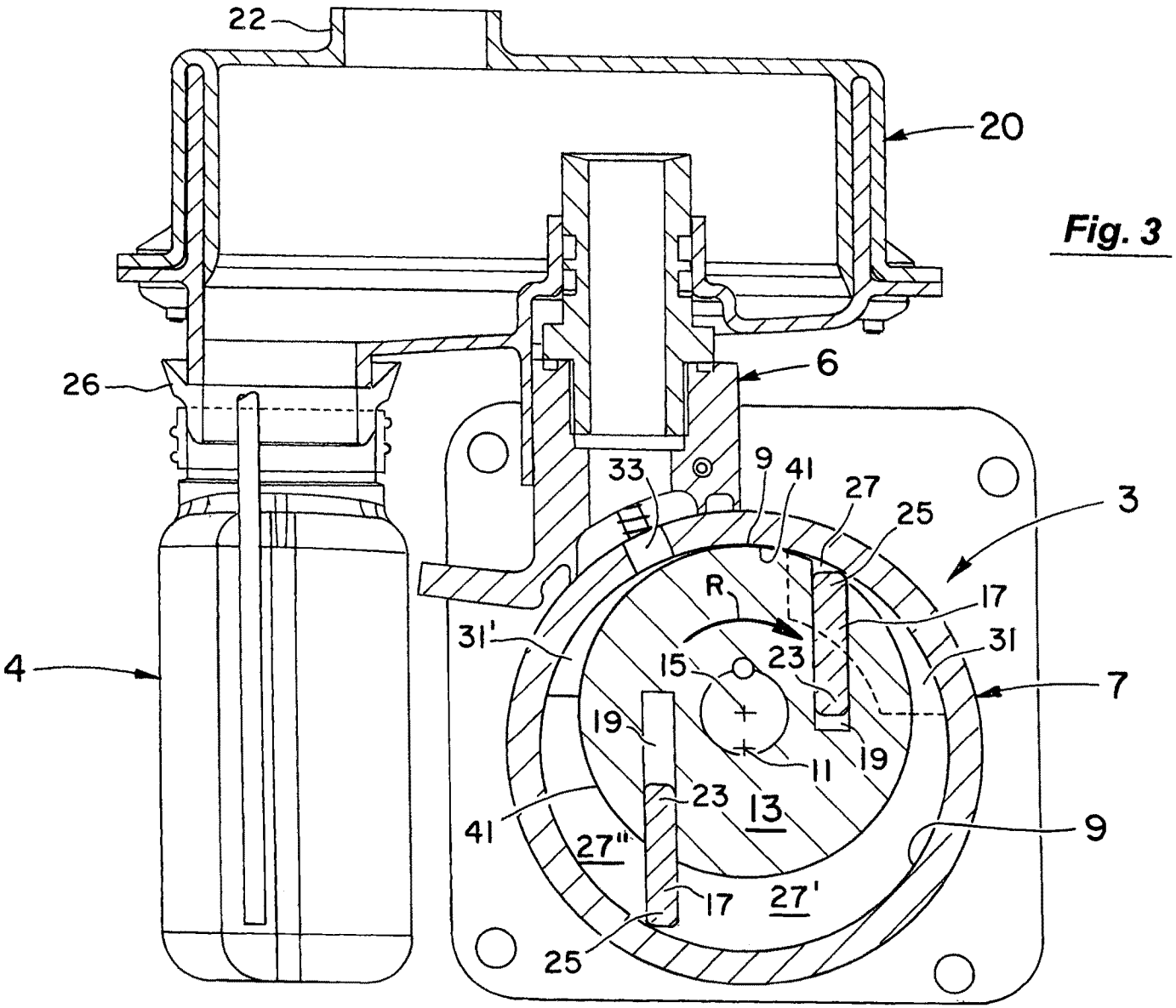
FIG. 3 is a view taken generally along line 3-3 of FIG. 2.

As illustrated in FIGS. 1 and 2, the pump 1 of the present invention is a portable unit and includes a rotary vane, vacuum pump 3 (see FIGS. 2 and 3) driven by the electric motor 5 (FIG. 2). The vane pump 3 as best seen in FIG. 3 (which is a view taken generally along line 3-3 of FIG. 2) has a housing 7 with an inner surface 9 extending about the axis 11 to define in part a bore. The rotor 13 of the pump 1 is mounted within the bore (FIG. 3) for rotation about the axis 15. The axis 15 as illustrated is offset from and substantially parallel to the housing axis 11. The rotor 13 also includes at least two vanes 17 mounted for sliding movement within the respective slots 19.

In operation, the motor 5 of FIG. 2 rotates the rotor 13 in a first direction 21 (clockwise in FIG. 3) about the axis 15 within the bore of the housing 7. In this regard, each vane 17 of the rotor 13 has an inner 23 and outer 25 edge portion. The outer edge portions 25 contact the inner surface 9 of the housing 7 due to the centrifugal forces developed as the rotor 13 is rotated by the motor 5 about the axis 15. The vanes 17 then progressively separate the bore of the housing 7 into a plurality of chambers 27, 27', and 27" as shown.

Figure 4:
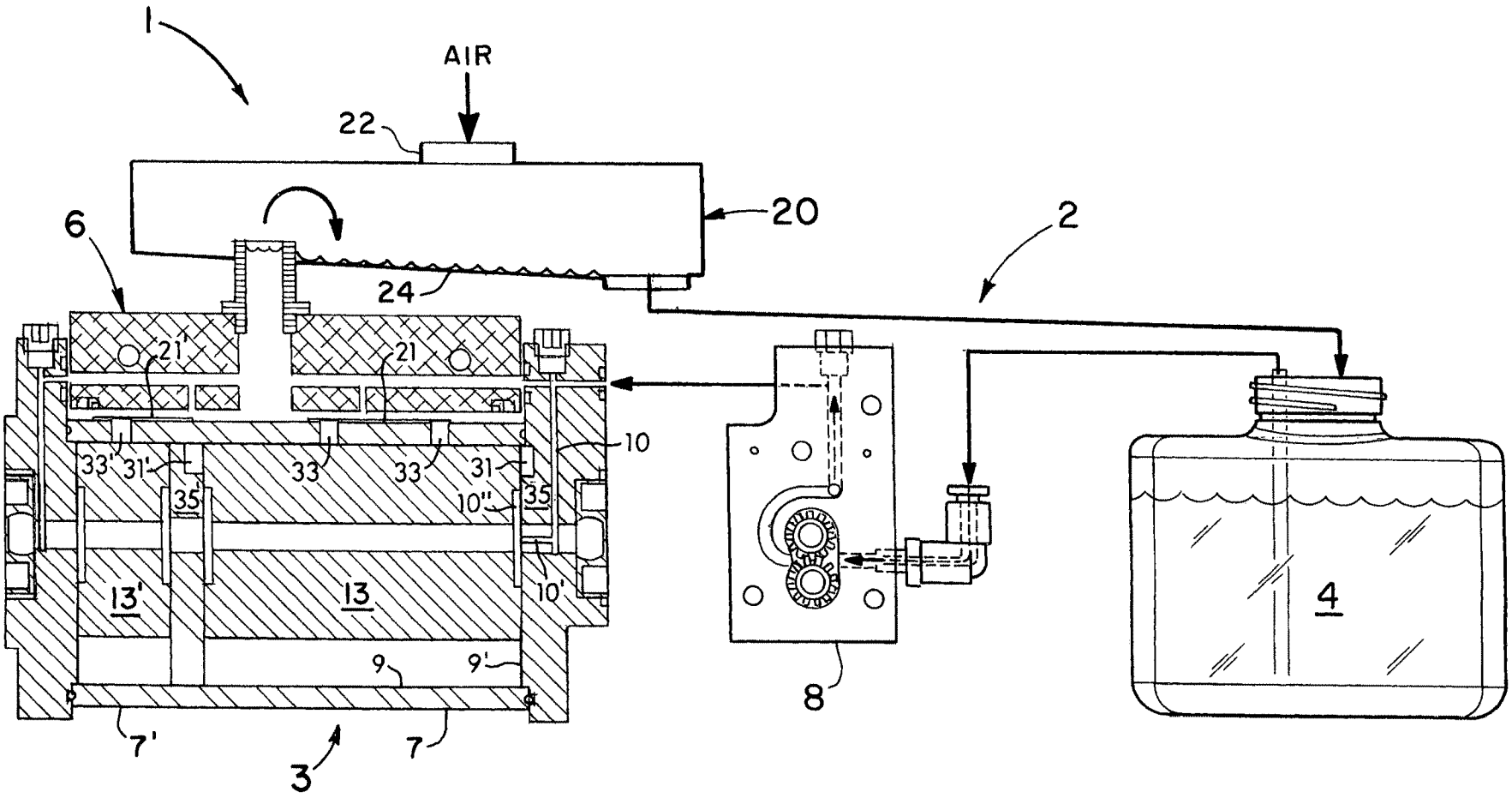
FIG. 4 is a schematic illustration of the lubricating oil system of the pump including its oil inlet and oil return arrangements.

The housing 7 of FIG. 3 further includes at least one inlet passage 31 in the inner surface 9' (see also FIG. 4) of the housing end wall 35 and at least one outlet passage 33 through the inner surface 9 (FIGS. 3 and 4). The passages 31 and 33 are respectively in fluid communication with the bore of the housing 7 with the inlet passage 31 connected to the system or unit 12 to be evacuated via the inlet porting at 37 of FIG. 1. It is noted that although the inlet and outlet passages 31, 33 are shown in FIGS. 3 and 4 in the respective surfaces 9 and 9', these passages could be ported in any of the surfaces forming the housing bore. In any event, the rotor 13 as shown in FIG. 3 is substantially cylindrical with a substantially cylindrical outer surface 41 extending about the rotor axis 15 and abutting the inner surface 9 of the housing 7 at an upper location between the inlet and outlet passages 31, 33.

The pump 1 of the present invention as schematically shown in FIG. 4 has a lubricating oil system 2 which includes an inlet oil arrangement and an oil return arrangement. As explained in more detail below, the oil inlet arrangement supplies oil from the primary oil container 4 (FIG. 4) to the vane pump 3 and to the secondary oil container 6. The oil return arrangement then delivers oil back from the vane pump 3 and secondary oil container 6 to the primary container 4, all while the containers 4, 6 are open to atmosphere and at ambient pressure.

More specifically, the oil inlet arrangement of the system 2 as illustrated in FIG. 4 includes the primary oil reservoir container 4 (e.g., 8 ounces), the much smaller secondary oil reservoir oil container 6 (e.g., 0.5 ounces), and an oil pump mechanism 8 between the primary and secondary containers 4, 6. The oil pump mechanism 8 is preferably a positive displacement one such as the illustrated gear pump. The pump mechanism 8 serves to move oil from the primary container 4 to the secondary container 6 with both containers 4, 6 being open to atmosphere as shown and for all practical purposes at ambient pressure.

Figure 6:
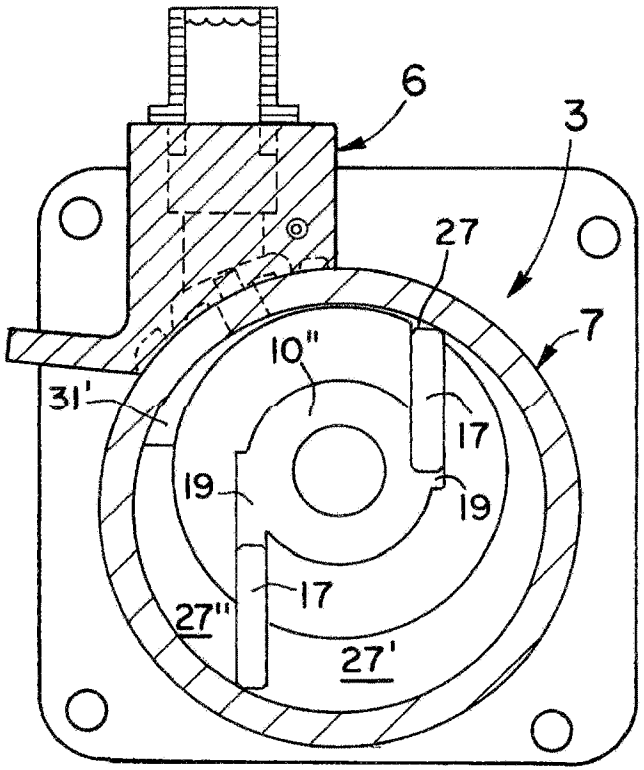
FIG. 6 is a view taken along line 6-6 of FIG. 5.
Figure 5:
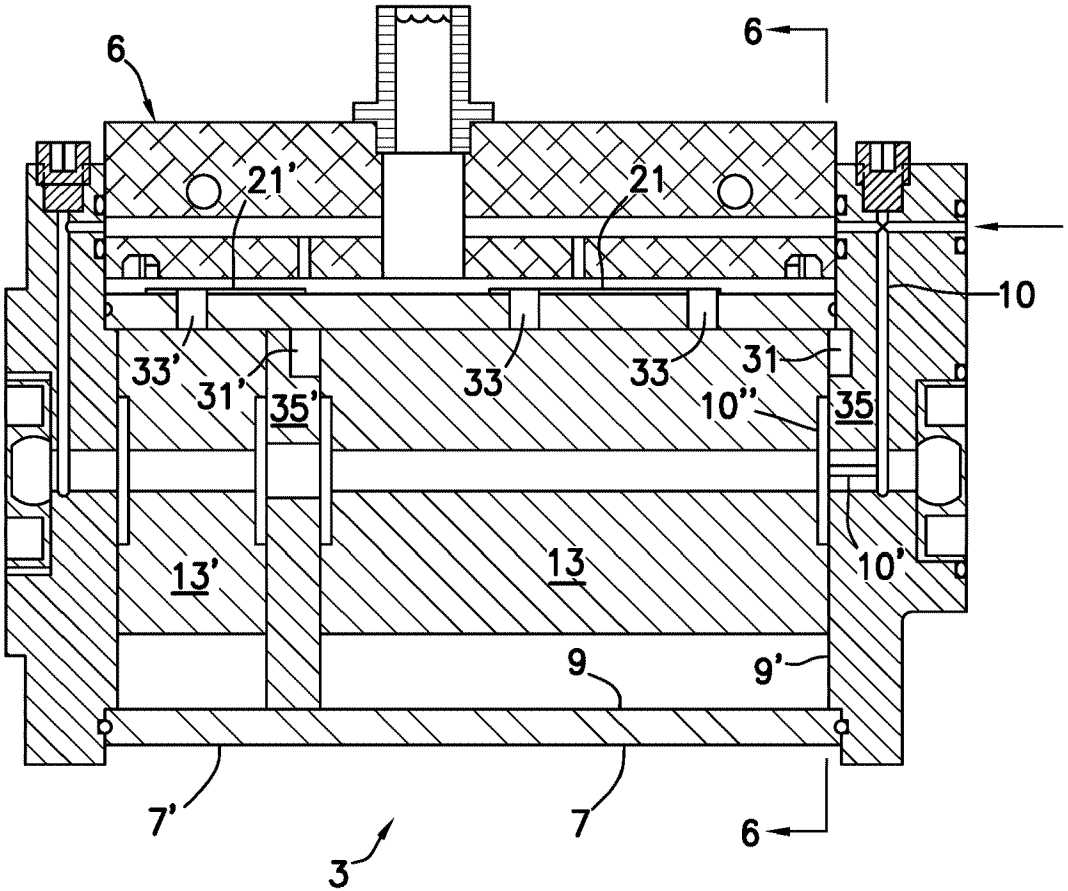
FIG. 5 is an enlarged view of the oil inlet arrangement supplying oil from the primary oil container to the vane pump and to the secondary oil container.

The oil inlet arrangement supplies oil from the primary container 4 downstream of the oil pump mechanism 8 through the illustrated path or passage 10, 10', 10" (see FIGS. 4 and 5) to at least one chamber (e.g., 27' in FIG. 6) and preferably to all of the vane pump chambers 27, 27', and 27" of FIG. 6. It is noted that the path portion 10 is preferably immediately adjacent the secondary oil container 6 but can be part of the container 6 if desired. In any event and in supplying oil to the vane pump 3, the evacuated chambers (e.g., 27') are at pressure less than ambient. Consequently, the evacuated chambers draw or suck oil along the path or passage 10, 10', 10" (FIG. 5) through the vane slots 19 (FIG. 6) past the vanes 17 and into the evacuated bore of the housing 7. The oil inlet path or passage 10, 10', 10", 19 in this regard is in fluid communication with the secondary oil container 6 (FIGS. 4 and 5) and the secondary container 6 in turn is open to the atmosphere (FIG. 4) and at ambient pressure.

Figure 7:
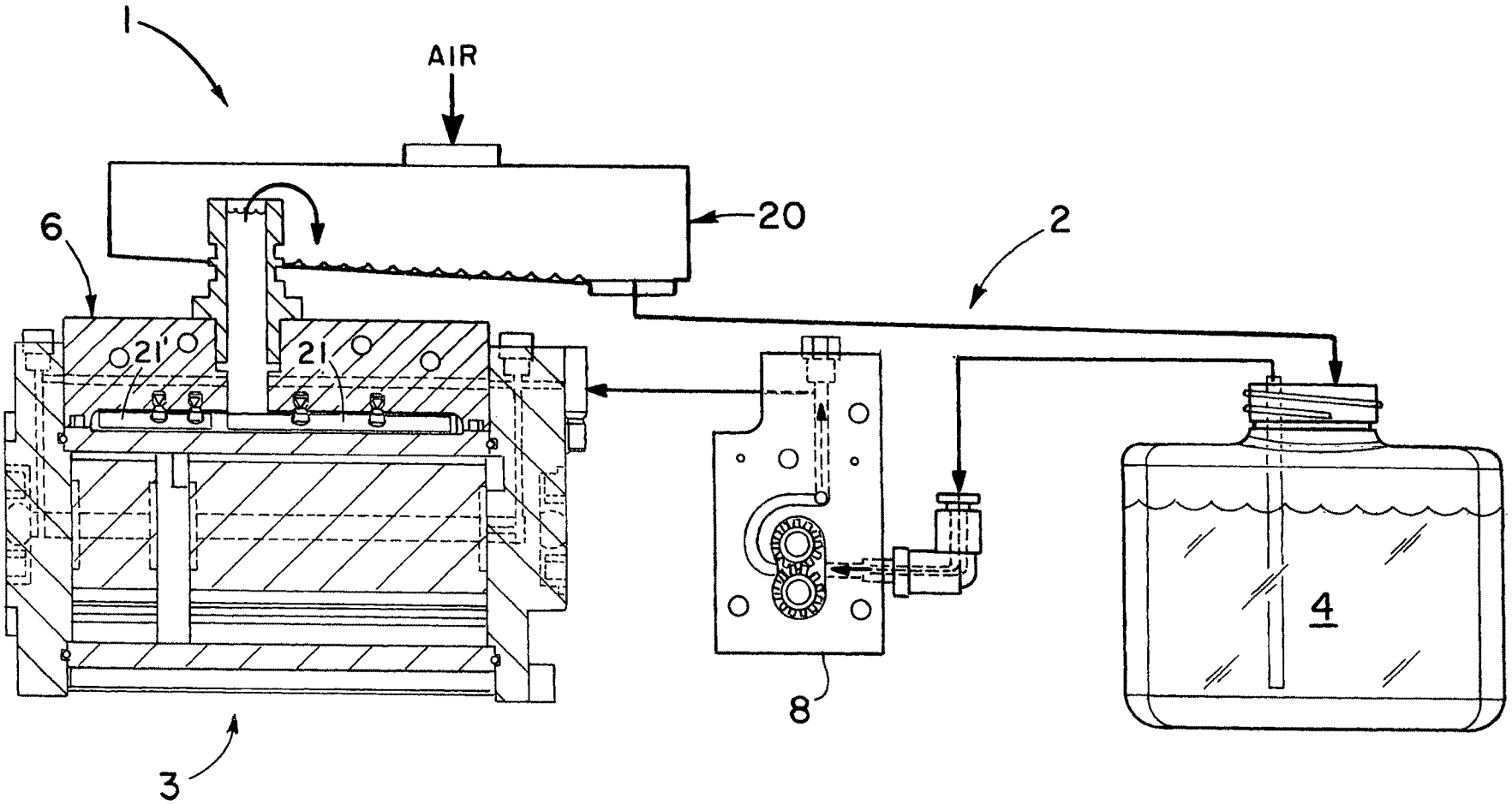
FIGS. 7 and 8 are views similar to FIG. 4 showing the reed or flapper valves in their closed (FIG. 7) and open (FIG. 8) positions.
Figure 8:
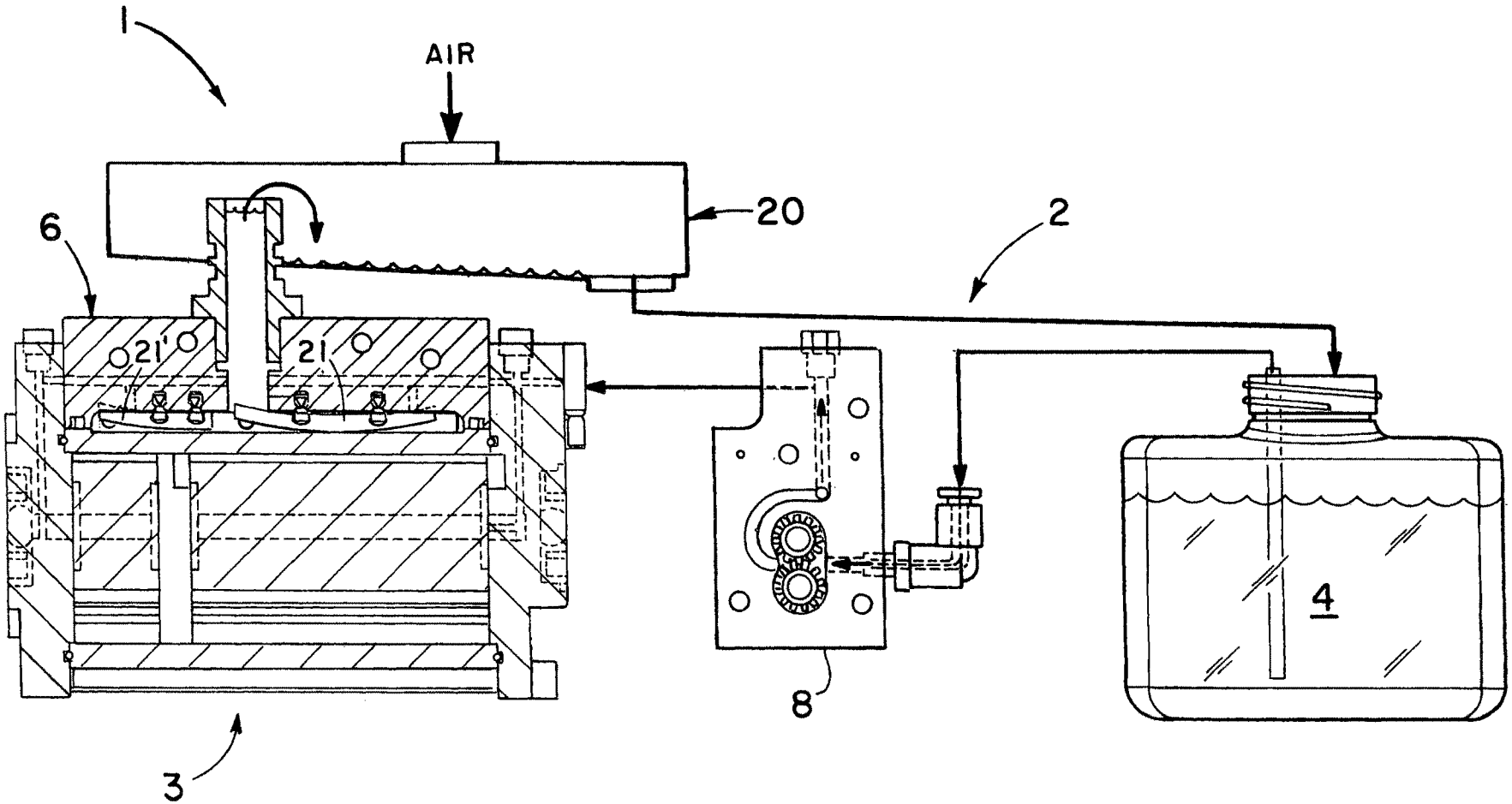

The oil return arrangement of the lubricating oil system 2 as indicated above delivers the oil back from the vane pump 3 and secondary oil container 6 to the primary oil container 4. In this regard, the oil in the bore of the housing 7 of the vane pump 3 supplied through the path or passage 10, 10', 10", 19 as previously discussed exits the vane pump 3 (FIG. 4) through the outlet passages 33. The oil then passes by the reed or flapper valve 21 into the secondary container 6. The reed valve 21 is spring biased toward its closed position of FIGS. 4 and 7 and selectively opens (FIG. 8) and closes (FIG. 7) the outlet passages 33. The reed or similar valve 21 essentially vibrates or flaps in response to the pressure waves and volumes of gas and oil moving out of the housing bore past the valve 21. In doing so, the discharged mixture of gas and oil gurgles or bubbles up through the oil in the secondary container 6 (FIG. 4) into the separating chamber 20. The separating chamber 20 is part of the oil return arrangement to the primary oil container 4 and is open to atmosphere at 22 and at ambient pressure. In the chamber 20, the gas from the vane pump 3 that discharged into the oil of the secondary container 6 separates from the oil and discharges to atmosphere through the opening 22. The separated oil in turn preferably returns by gravity along the downwardly inclined surface 24 of the chamber 20 and flows back into the primary oil container 4. The circuit of the oil is then repeated until the motor 5 is shut down either intentionally (e.g., by the operator) or unintentionally (e.g., by someone tripping over the power cord to the pump or a circuit breaker is tripped).

Upon the motor 5 being shut down and the rotor 13 ceasing to be driven, the vacuum in the bore of the housing 7 (e.g., less than ambient and as deep as 500 or even 20 microns of mercury) is automatically broken and vented to atmosphere. The venting is done from the secondary container 6 (FIG. 4) which is open to atmosphere and at ambient pressure via the oil inlet path or passage 10, 10', 10", 19 to the housing bore. In doing so, it is noted that a small amount of oil in the secondary oil container 6 and the path or passage 10, 10', 10", 19 may be sucked into the housing bore with the incoming, venting air. Some of this oil may also be sucked from the housing bore into the system or unit being evacuated if it still connected to the vane pump 3. However, the amount of oil that may be drawn in is essentially only what is in the venting path of the secondary oil container 6 and portions 10, 10', 10", 19. This amount is so small (e.g., 0.5 ounces or slightly more) compared to the volume (e.g., 2.5 ounces or more) of the chambers 27, 27', 27" as not to create a problem in the vane pump 3 or the unit being evacuated. In contrast, current designs may undesirably draw oil into the pump chambers and into the unit if it still connected until the vacuum is broken somewhere. By that time, the vane pump may be completely filled with incompressible oil and the unit contaminated with oil. The contaminated unit must then be thoroughly cleaned of oil involving considerable time and expense. Additionally, the vane pump must also be drained of the excess oil before restarting otherwise it may be severely damaged.

The vane pump 3 of the present invention can be a single or multiple stage pump. In a multiple stage design as in FIG. 4, the rotor 13' of the housing 7' of the second stage operates essentially the same as the rotor 13 of the first stage. The oil in this regard for the second stage can be drawn into the bore of the second stage via a path or passage similar to 10, 10', 10", 19 of the first stage. However, in the preferred embodiment of FIG. 4, the oil enters the housing 7' of the second stage entrained in the gas and oil being discharged from the first stage. That is, the mixed gas and oil in the first stage normally will exit through the discharge passages 33 of FIG. 4 past the reed valve 21 (see also FIG. 8) until a first vacuum is drawn (e.g., 500 microns of mercury). The reed valve 21 will then typically close or be drawn shut and the complete discharge from the first stage will be drawn through the inlet port 31' (FIG. 4) in the end wall 35' into the second stage. A deeper vacuum (e.g., 20-50 microns of mercury) is then drawn by the second stage with the gas and oil mixture exiting through the discharge port 33' of FIG. 4 past the reed valve 21'. In such a multiple stage design and should the motor 5 be shut down intentionally or not, the reed valve 21' like the reed valve 21 of the first stage will be sucked down and closed. The second stage will then vent through its inlet port 31' from the first stage and to atmosphere via the path or passage 19, 10", 10', 10 and the secondary oil reservoir 6 as discussed above.

The automatic vacuum breaking arrangement of the present invention can then serve to safely vent single or multiple stage pumps. In doing so, the primary oil reservoir container 4 and secondary oil reservoir container 6 can at all times be open to the atmosphere and at ambient pressure.

The primary oil reservoir container 4 is preferably connected at 26 in FIG. 3 to the chamber 20 and can easily be manually removed. The primary container 4 can preferably hold virtually all of the oil (e.g., 8 ounces) in the oil lubricating system 2 and can be used to change out the oil whether or not the vane pump 3 is operating. That is, a quick change of the system's oil can be made by replacing the original container 4 with a fresh one full of clean oil. If the vane pump 3 is still operating, there is normally enough oil remaining in the system to keep it safely running during the change. The primary container 4 in this regard is preferably made of substantially clear, rigid material (e.g., plastic) and positioned in the front of the main body of the pump 1 (FIGS. 1 and 2) behind a clear door so the condition of the oil can be visually monitored and a change made as needed.

In the preferred embodiment, the primary oil reservoir 4 is essentially the entire sump (e.g., 8 ounces) for the oil of the system and can easily be removed from the main body of the pump 1. The remainder of the system then contains only a relatively small fraction of oil compared to the primary container 4. The secondary container 6, for example, may contain about 1/10 or less (e.g., 1/16 or 0.5 fluid ounces) of the volume of oil in the primary container 4. The residual oil in the rest of the system may be even less. Because the pump is not submerged in the sump oil, the various parts of the main body including the vane pump 3 and motor 5 can be air cooled (e.g., by the fan 30 of FIG. 2). This in contrast to pumps that are completely or partially submerged in the sump oil for cooling. The current design thus results in a much simpler design with less need for expensive sealing throughout the system. It also avoids many potential problems of submerged pumps such as the draw or suck back problem discussed above. Submerged pumps in particular may undesirably draw oil from the sump not only along flow lines but also between any and all abutting parts when the motor is shut down. Further in regard to the cooling fan 30, it like the vane pump 3 and pump mechanism 8 can be conveniently driven from the common motor 5 directly (e.g., 1700 RPM) or through gearing if desired.

Figure 9:
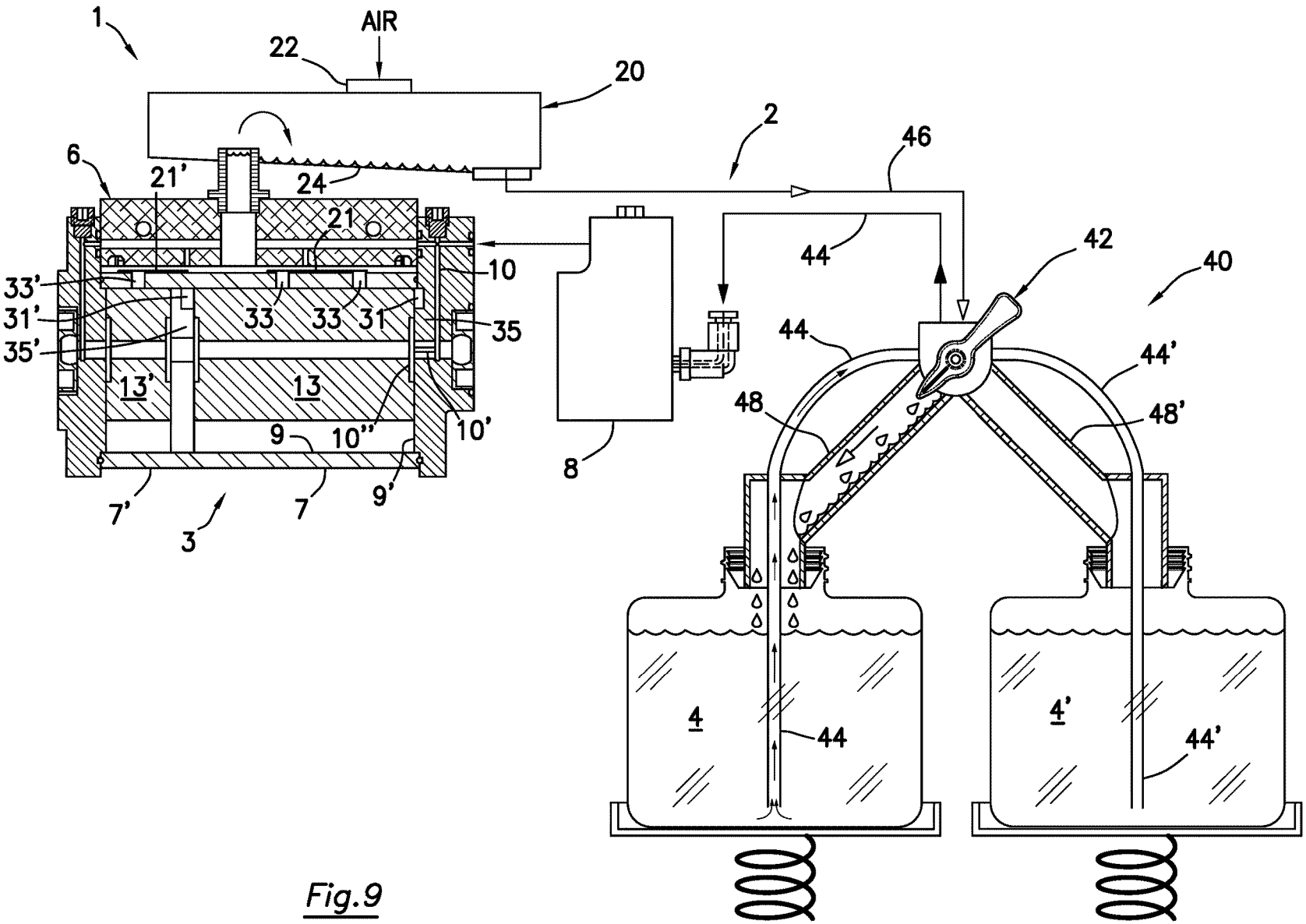
FIGS. 9-11 illustrate the quick oil change system in which multiple containers of oil can be used and replaced when contaminated or dirty, all without interrupting the evacuating operation of the vane pump.
Figure 10:
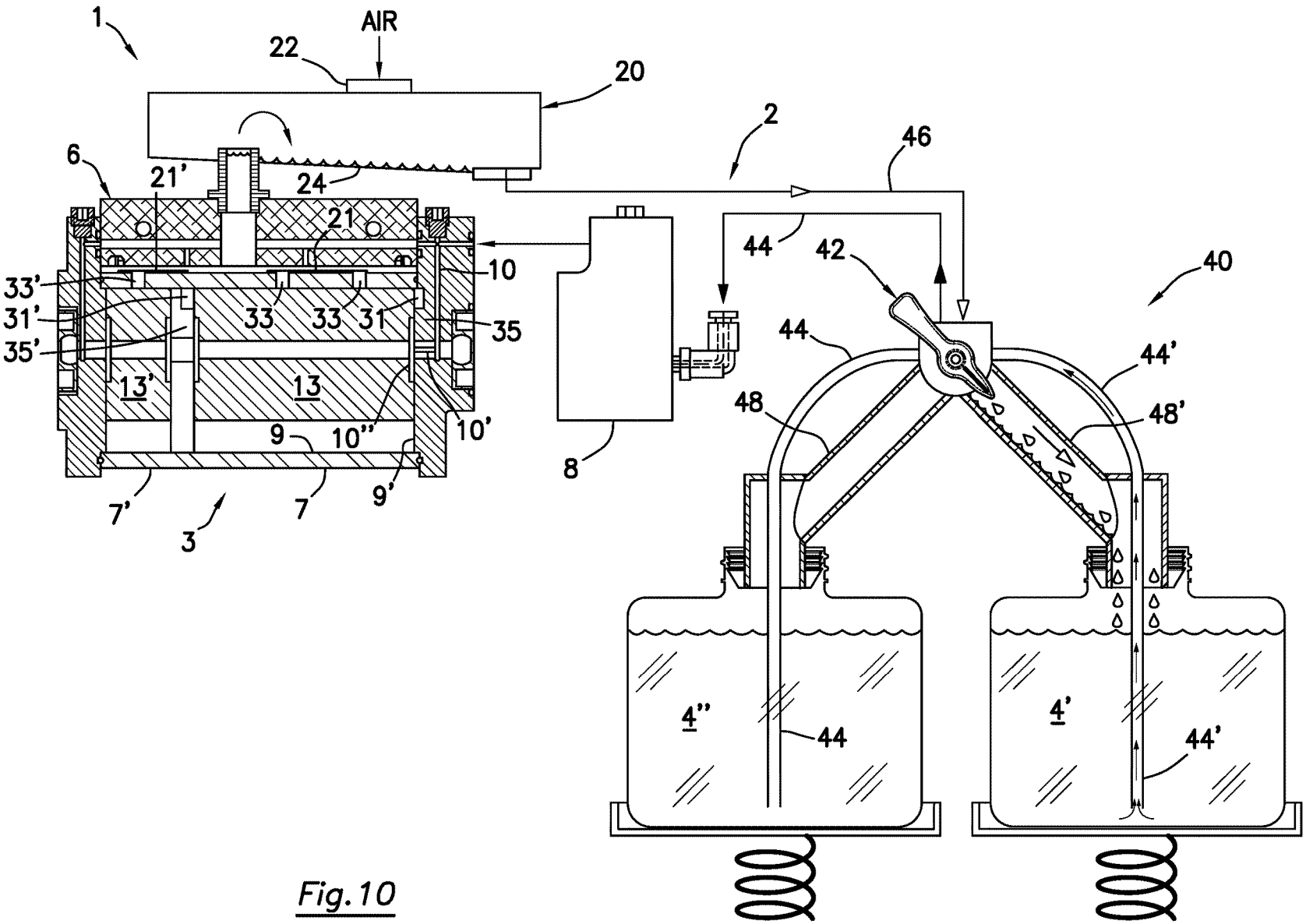
Figure 11:
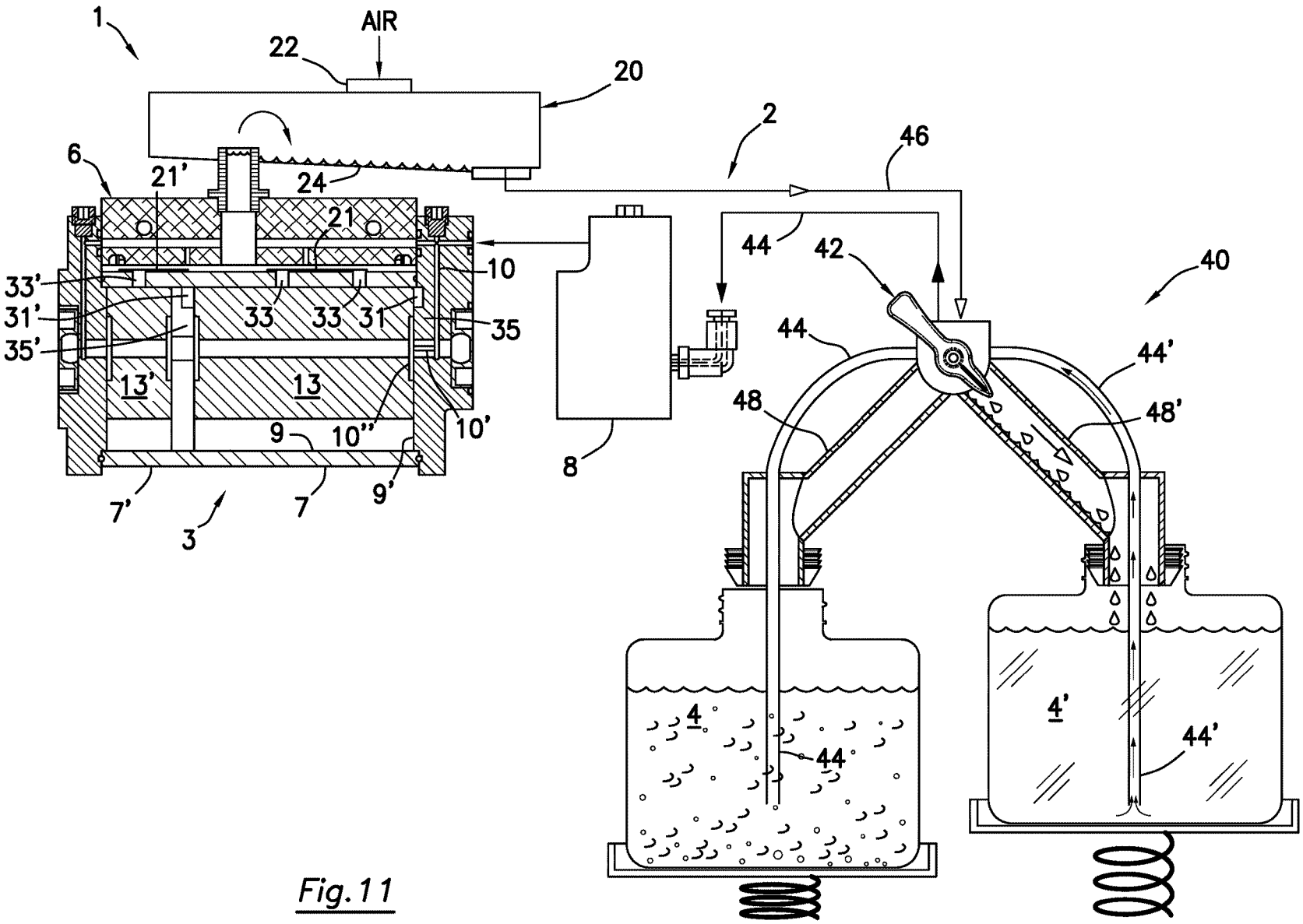

In the embodiment of FIGS. 9-11, the vacuum pump 1 is provided with a modified oil system at 40. In this modification, a second container of oil 4' is positioned at a second location adjacent the first location of the first container of oil 4 of FIGS. 4 and 7-8 and a manual switch mechanism 42 (FIG. 9) is provided to selectively draw oil from and return oil to either of the oil containers 4, 4' (see FIGS. 9-10). In doing so, for example, the oil container 4 of FIG. 9 can initially serve as the primary oil reservoir for the vacuum pump 1 as in FIG. 8. However, after being in use and the oil in the container 4 becoming contaminated or dirty and losing its effectiveness (e.g., as measured by a vacuum gauge), the switch mechanism 42 can be moved to a second position as in FIG. 10 to make the clean oil in the container 4' serve as the primary oil reservoir. The dirty oil container 4 can then be removed (FIG. 11) and replaced with a third container 4" of clean oil (FIG. 10). The "third" container 4" in this regard can be a new one or just the removed, dirty first container 4 refilled with clean oil put back in place. In either case, the switch and replacement process can subsequently be repeated with a fourth container of clean oil substituted for the second container 4' of FIG. 11 when it becomes dirty and so on. Similarly, such a "fourth" container can also be a new one or just the removed, dirty second container 4' refilled with clean oil and returned in place. The switch mechanism 42 and dual, replaceable oil container arrangement thus allow for a quick change of the oil for the vacuum pump 1 that can be done while the vacuum pump 1 is still operating to evacuate the air conditioning and refrigeration (AC/R) system. The change is substantially instantaneous as it can be done as fast as the user can flip the switch mechanism 42.

FIGS. 12-16 offer more views of the operation of this quick oil change system. In the perspective view of FIG. 12 and in FIG. 13, the switch mechanism 42 is shown in a first position. In this first position, the clean oil of container 4 is being drawn out of the container 4 by the oil pump mechanism 8 of FIG. 9 via its inlet line 44 (see again FIG. 12). Additionally, oil is being received back via return line 46 from the secondary oil reservoir 20 to the switch mechanism 42 and directed through the switch mechanism 42 to return oil back by the line 48 into the container 4 (see also FIG. 16). With the switch mechanism 42 in this first position in FIG. 9, the inlet line 44' to the oil pump mechanism 8 associated with the reserve second container of oil 4' is isolated from fluid communication with the oil pump mechanism 8 (see also FIGS. 14-16). The oil return line 48' to the second container 4' is also isolated by the switch mechanism 42 in this first position from fluid communication with the oil return line 46 from the secondary oil reservoir 20.

In FIGS. 17-21, the switch mechanism 42 has been moved to a second position in which the clean oil of the reserve second container 4' is now being drawn by the oil pump mechanism 8 up the inlet line 44' into the oil pump mechanism 8. Additionally, in this second position, oil is now being received back from the secondary oil reservoir 20 (see also FIG. 10) along the return line 46 from the secondary oil reservoir 20 and directed through the switch mechanism to return oil back via line 48' in FIGS. 17-21 into the container 4'. With the switch mechanism 42 in this second position of FIGS. 17-21, the inlet line 44 to the oil pump mechanism 8 associated with the container 4 isolated from fluid communication with the oil pump mechanism 8 (FIGS. 19-21). The oil return line 48 to the first container 4 is also isolated by the switch mechanism 42 from fluid communication with the return line 46 from the secondary oil reservoir 20 (see also FIG. 10).

In the second position of the switch mechanism 42 in FIGS. 17-21, the first container 4 of dirty oil which is removably mounted to the vacuum pump 1 can then be manually removed as in FIG. 10 and manually replaced with a third container 4" of clean oil as in FIG. 11. In doing so and since the first container 4 of dirty oil is isolated by the switch mechanism 42, there is no interruption of the operation of the vacuum pump 1 to evacuate the AC/R system. More importantly, the oil change from the first to the second oil container is literally done in the time it takes for the user to manually flip the switch mechanism 42 and there is no time rush to remove and replace the dirty oil container 4 with a clean one 4" should the user's attention be needed elsewhere. As noted above, the third container 4" can be a new one or just the removed, dirty first container 4 refiled with clean oil and remounted to become the third container in use in this illustrated series, which series can be repeated throughout the entire evacuation process.

The oil change system 40 of FIGS. 9-21 is thus selectively operable in first and second modes. In the first mode of FIGS. 12-16 as discussed above, the first container of oil 4 is positioned at a first location on the vacuum pump 1 and serves as the primary oil reservoir in fluid communication with the oil pump mechanism 8. The reserve second container 4' of oil is then positioned at a second location on the vacuum pump 1 and is isolated from fluid communication with the oil pump mechanism 8. In the second mode of FIGS. 17-21 as also discussed above, the reserve second container 4' of oil positioned at the second location on the vacuum pump 1 operably replaces the first container 4 of oil and serves as the primary oil reservoir in fluid communication with the oil pump mechanism 8. The first container 4 at the first location on the vacuum pump 1 is then isolated from fluid communication with the oil pump mechanism 8. The first container 4 is removably mounted at the first location to the vacuum pump 1 and a third container of oil 4" is removably mountable to the vacuum pump at the first location. In this manner as discussed above, the first container 4 of now dirty oil can be removed in the second operating mode of the switch mechanism 42 and replaced with a third container 4" of clean oil at the first location on the vacuum pump 1 (which third container 4" can be the removed first container 4 refilled with clean oil as discussed above). Subsequently as the oil in the second container 4' becomes dirty, the switch mechanism 42 can be returned to its first position and first operating mode with the third container 4" in use (either a new one or container 4 refilled) serving as the primary oil reservoir and in fluid communication with the oil pump mechanism. Additionally and as to the return oil arrangement 2, the returning oil from the secondary oil reservoir 20 is selectively delivered by gravity via the return line 46 into the respective oil container (e.g., 4, 4', or 4") that is being selected by the switch mechanism 42 to serve as the primary oil reservoir.

The switch mechanism 42 is designed to produce an audible click when moved between the first and second positions and operating modes to alert the user that the move has been made. The switch mechanism 42 in this regard is spring biased at 50 in FIGS. 13 and 18. When moving the switch mechanism 42 between operating modes or positions, the one leg 50' of the spring 50 rides up and over the apex 52 and then respectively snaps back either against the surface 54 or 54' to create the audible click. This motion also produces a tactile force that the user can feel if the operating environment is too loud to easily hear the click. Additionally and more importantly, this spring-biased snap action makes the switch between the dual oil containers essentially instantaneous. The switch mechanism 42 is then preferably a binary one in the sense that it is either in its first operating mode or its second one and the user does not have to be concerned that it is somewhere between the two.

Figure 22:
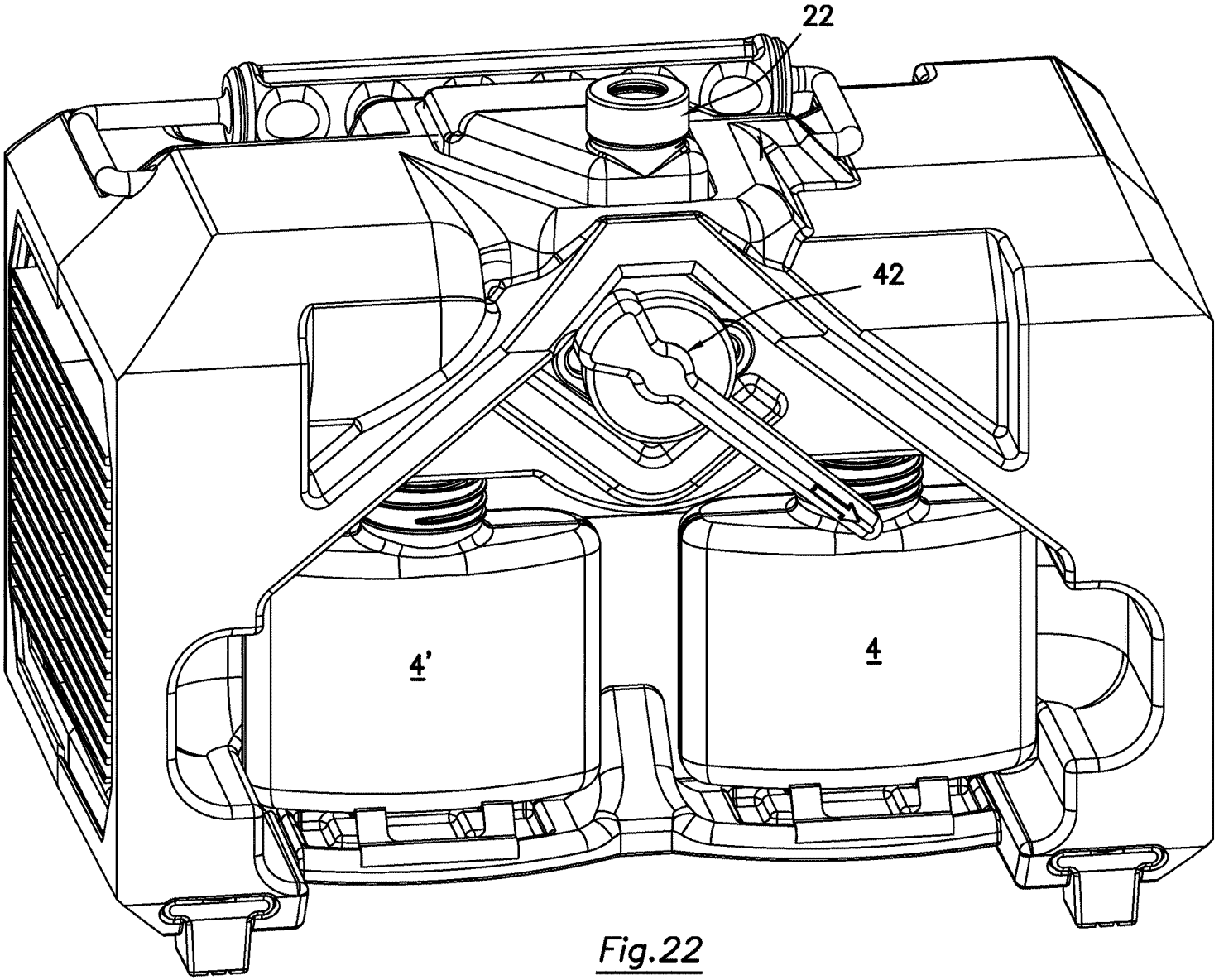
FIG. 22 is a perspective view of another embodiment of the portable pump having a switch mechanism 42 with a valve handle that indicates the container (4 or 4') selected as the primary oil reservoir and prevents removal of that container.

FIG. 22 shows another embodiment of the present invention having a switch mechanism 42 with a valve handle that can be moved between two positions to select which of the containers 4 or 4' will serve as the primary oil reservoir. This valve handle provides a visual indication of the selected container 4 (in FIG. 22) and prevents its removal from the vacuum pump while in use as the primary oil reservoir. The other container 4' that has not been selected as the primary oil reservoir is unblocked by the valve handle and can be freely removed as previously discussed.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

We claim:

1. A portable vacuum pump for evacuating an air conditioning and refrigeration (AC/R) system to a pressure substantially below ambient, atmospheric pressure, said vacuum pump comprising:

a housing with an interior bore and an oil inlet passage and an oil outlet passage through the housing in respective fluid communication with the bore of the housing, a lubricating oil system having an oil inlet arrangement and an oil return arrangement, said oil inlet arrangement including a primary oil reservoir, a secondary oil reservoir, and an oil pump mechanism positioned between the primary oil reservoir and the secondary oil reservoir and upstream of the bore of the pump housing to move oil from the primary oil reservoir to the secondary oil reservoir and to the bore of the pump housing while the vacuum pump is operating to evacuate the AC/R system with the primary oil reservoir and the secondary oil reservoir open to the atmosphere and at ambient pressure, said bore of the pump housing being at pressure less than ambient when the vacuum pump is operating to evacuate the AC/R system wherein oil is drawn into the bore of the pump housing along a first flow path upstream of the bore of the pump housing and downstream of the oil pump mechanism with said primary and secondary oil reservoirs open to the atmosphere and at ambient pressure, said oil return arrangement delivering oil via a second, return flow path from the bore of the pump housing and the secondary oil reservoir back to the primary oil reservoir with the primary and secondary oil reservoirs open to the atmosphere and at ambient pressure, said lubricating oil system further including at least first and second manually removable containers of oil and a switch mechanism selectively operable between first and second positions, said switch mechanism in said first position (a) placing the oil in the first container in fluid communication with the oil pump mechanism to become the primary oil reservoir and (b) placing the return flow path of the oil return arrangement in fluid communication with the first container to return oil from the secondary oil reservoir to the first container while isolating the second container from fluid communication with the oil pump mechanism and with the return flow path of the oil return arrangement and said switch mechanism in the second position (c) placing the oil in the second container in fluid communication with the oil pump mechanism to become the primary oil reservoir and (d) placing the return flow path of the oil return arrangement in fluid communication with the second container to return oil from the secondary oil reservoir to the second container while the vacuum pump is operating to evacuate the AC/R system, said switch mechanism in the second position additionally isolating the first container from fluid communication with the oil pump mechanism and with the return flow path of the oil return arrangement wherein said first container with the switch mechanism in the second position with the second container serving as the primary oil reservoir can be manually removed from the vacuum pump while the vacuum pump is operating to evacuate the AC/R system and with the primary oil reservoir of the second container and the secondary oil reservoir open to the atmosphere and at ambient pressure.

2. The portable vacuum pump of claim 1 wherein said first and second containers can be initially placed in respective first and second locations on the vacuum pump and wherein the first container can be removed from the first location, refilled with clean oil, and returned back to the first location with the switch mechanism in said second position.

3. The portable vacuum pump of claim 2 wherein said switch mechanism can be returned to said first position with the first container returned back to the first location (a) to place the oil in the returned first container in fluid communication with the oil pump mechanism to again become the primary oil reservoir and (f) to place the return flow path of the oil return arrangement again in fluid communication with the returned first container while isolating the second container from fluid communication with the oil pump mechanism and with the return flow path of the oil return arrangement.

4. The portable vacuum pump of claim 1 wherein said first and second containers can be initially placed in respective first and second locations on the vacuum pump and wherein the first container can be removed from the first location and can be replaced with a third container of oil at said first location with the switch mechanism in said second position.

5. The portable vacuum pump of claim 4 wherein said switch mechanism can be returned to said first position with the first container removed and the third container replacing the removed first container at the first location (a) to place the oil in the third container in fluid communication with the oil pump mechanism to become the primary oil reservoir and (f) to place the return flow path of the oil return arrangement in fluid communication with the third container while isolating the second container from fluid communication with the oil pump mechanism and with the return flow path of the oil return arrangement.

6. The portable vacuum pump of claim 1 wherein the switch mechanism is manually operable and produces an audible click sound when moved between said first and second positions to alert the user that the move between the first and second operating modes has been made.

7. The portable vacuum pump of claim 1 wherein the switch mechanism is spring-biased to snap between said first and second positions.

8. The portable vacuum pump of claim 1 wherein the secondary oil reservoir holds less than 1/10 the volume of the primary oil reservoir.

9. The portable vacuum pump of claim 8 wherein the secondary oil reservoir holds less than 1/16 the volume of the primary oil reservoir.

10. The portable vane pump of claim 1 wherein the primary oil reservoir contains substantially all of the oil in the vacuum pump.

11. The portable vacuum pump of claim 1 wherein the first and second containers of oil are sized to respectively hold an equal volume of oil.

12. The portable vacuum pump of claim 1 wherein the switch mechanism further comprises a valve handle having first and second positions for selecting and visually indicating which of the first and second containers serves as the primary oil reservoir, and preventing removal of the selected container while allowing removal of the container not selected as the primary oil reservoir.

13. A portable vacuum pump for evacuating an air conditioning and refrigeration (AC/R) system to a pressure substantially below ambient, atmospheric pressure, said vacuum pump comprising:

a housing with an interior bore and an oil inlet passage and an oil outlet passage through the housing in respective fluid communication with the bore of the housing, a lubricating oil system having an oil inlet arrangement, said oil inlet arrangement including a primary oil reservoir, a secondary oil reservoir, and an oil pump mechanism positioned between the primary oil reservoir and the secondary oil reservoir and upstream of the bore of the pump housing to move oil from the primary oil reservoir to the secondary oil reservoir and to the bore of the pump housing while the vacuum pump is operating to evacuate the AC/R system with the primary oil reservoir and the secondary oil reservoir open to the atmosphere and at ambient pressure, said bore of the pump housing being at pressure less than ambient when the vacuum pump is operating to evacuate the AC/R system wherein oil is drawn into the bore of the pump housing along a first flow path upstream of the bore of the pump housing and downstream of the oil pump mechanism with said primary and secondary oil reservoirs open to the atmosphere and at ambient pressure, said oil inlet arrangement further including an oil change system having a first container of oil and a reserve second container of oil respectively positionable at first and second locations on the vacuum pump, said oil change system being selectively operable between first and second modes, (a) said oil change system in said first operating mode having the first container of oil positioned at said first location on the vacuum pump and serving as the primary oil reservoir and being in fluid communication with the oil pump mechanism with the reserve second of oil positioned at said second location on the vacuum pump and being isolated from fluid communication with the oil pump mechanism and (b) said oil change system in said second operating mode having the reserve second container of oil positioned at said second location on the vacuum pump operably replacing the first container of oil and serving as the primary oil reservoir and being in fluid communication with the oil pump mechanism while the vacuum pump is operating to evacuate the AC/R system, said oil change system in said second operating mode with the first container of oil at said first location on the vacuum pump isolating said first container from fluid communication with the oil pump mechanism while the vacuum pump is operating to evacuate the AC/R system and with the primary oil reservoir of the second container and the secondary oil reservoir open to the atmosphere and at ambient pressure.

14. The portable vacuum pump of claim 13 wherein the first oil container of oil is removably mounted at said first location to the vacuum pump wherein said first container in the second operating mode of the oil change system can be removed from the first location, refilled with clean oil, and returned back to the first location and said oil change system can be returned to the first operating mode with the returned first container of oil again positioned at the first location on the vacuum pump again serving as the primary oil reservoir and being in fluid communication with the oil pump mechanism.

15. The portable vacuum pump of claim 14 wherein the oil change system further includes a switch mechanism to selectively move the oil change system from the first operating mode with the first container of oil serving as the primary oil reservoir to the second operating mode with the reserve second container of oil serving as the primary oil reservoir and back to the first operating mode with the returned first container of oil again at the first location on the vacuum pump and again serving as the primary oil reservoir.

16. The portable vacuum pump of claim 15 wherein the switch mechanism further comprises a valve handle having first and second positions for selecting and visually indicating which of the first and second containers serves as the primary oil reservoir, and preventing removal of the selected container while allowing removal of the container not selected as the primary oil reservoir.

17. The portable vacuum pump of claim 13 wherein the first oil container of oil is removably mounted at said first location to the vacuum pump and said oil change system further includes a third container of oil removably mountable to the vacuum pump at said first location wherein said first container in the second operating mode of the oil change system can be removed from the first location and replaced with the third container of oil at said first location and said oil change system can be returned to the first operating mode with the third container of oil positioned at the first location on the vacuum pump serving in place of the removed first oil container as the primary oil reservoir and being in fluid communication with the oil pump mechanism.

18. The portable vacuum pump of claim 17 wherein the oil change system further includes a switch mechanism to selectively move the oil change system from the first operating mode with the first container of oil serving as the primary oil reservoir to the second operating mode with the reserve second container of oil serving as the primary oil reservoir and back to the first operating mode with the third container of oil having replaced the first container of oil at the first location on the vacuum pump and serving as the primary oil reservoir.

19. The portable vacuum pump of claim 18 wherein the switch mechanism is manually operable and produces an audible click sound when moved between the first and second operating modes to alert the user the move between the first and second operating modes has been made.

20. The portable vacuum pump of claim 18 wherein the switch mechanism is spring-biased to snap between said first and second operating modes.

21. The portable vacuum pump of claim 13 wherein the oil change system further includes a switch mechanism to selectively move the oil change system from the first operating mode with the first container of oil serving as the primary oil reservoir to the second operating mode with the reserve second container of oil serving as the primary oil reservoir.

22. The portable vacuum pump of claim 21 wherein the switch mechanism is manually operable and produces an audible click sound when moved between the first and second operating modes to alert the user the move between the first and second operating modes has been made.

23. The portable vacuum pump of claim 13 wherein the lubricating oil system further includes an oil return arrangement, said oil return arrangement delivering oil via a second, return flow path from the bore of the pump housing and secondary oil reservoir back to the first container of oil while the oil change system is in said first operating mode and said oil return arrangement delivering oil via said return flow path from the bore of the pump housing and secondary oil reservoir back to the second container of oil while the oil change system is in said second operating mode.

24. The portable vacuum pump of claim 23 wherein the first oil container of oil is removably mounted at said first location to the vacuum pump wherein said first container in the second operating mode of the oil change system can be removed from the first location, refilled with clean oil, and returned back to the first location and said oil change system can be returned to the first operating mode with the returned first container of oil positioned at the first location on the vacuum pump again serving as the primary oil reservoir and being in fluid communication with the oil pump mechanism with the oil return arrangement delivering oil via the return flow path to the returned first container of oil again positioned at the first location on the vacuum pump, the second container of oil with the oil change system returned to said first operating mode being isolated from fluid communication with the oil pump mechanism and with the return flow path of the oil return arrangement.

25. The portable vacuum pump of claim 23 wherein the first oil container of oil is removably mounted at said first location to the vacuum pump and said oil change system further includes a third container of oil removably mountable to the vacuum pump at said first location wherein said first container in the second operating mode of the oil change system can be removed from the first location and replaced with the third container of oil at said first location and said oil change system can be returned to the first operating mode with the third container of oil positioned at the first location on the vacuum pump serving in place of the removed first oil container as the primary oil reservoir and being in fluid communication with the oil pump mechanism with the oil return arrangement delivering oil via the return flow path to the third container of oil positioned in place of the removed first container of oil at the first location on the vacuum pump and the oil change system in said first operating mode with the second container of oil isolated from fluid communication with the oil pump mechanism and from the return flow path of the oil return arrangement.

* * * * *